United States Patent [19]

Johnson et al.

[11] Patent Number: 4,576,406

[45] Date of Patent: Mar. 18, 1986

[54] ROTATIONAL GRAPPLE

[75] Inventors: Thomas E. Johnson; Terrance D. Spencer, both of Woodstock, Canada

[73] Assignee: Timberjack Inc., Woodstock, Canada

[21] Appl. No.: 607,881

[22] Filed: May 7, 1984

[51] Int. Cl.[4] ..... B66C 3/00

[52] U.S. Cl. ..... 294/86.41; 294/88

[58] Field of Search ..... 294/70, 86 R, 88, 106; 37/183 R, 187; 137/580; 414/732–735, 739

[56] References Cited

U.S. PATENT DOCUMENTS

| | | | |
|---|---|---|---|
| 3,413,029 | 11/1968 | Donovan | 294/88 X |
| 3,560,040 | 2/1971 | Funk | 294/88 X |
| 3,627,372 | 12/1971 | Carpenter et al. | 294/88 |
| 3,751,099 | 8/1973 | Billings | 294/88 |
| 3,877,743 | 4/1975 | Johnson | 294/88 |
| 4,358,147 | 11/1982 | Hungerford | 294/106 X |
| 4,426,110 | 1/1984 | Mitchell et al. | 294/88 |

FOREIGN PATENT DOCUMENTS

| | | | |
|---|---|---|---|
| 1077087 | 5/1980 | Canada | 294/88 |

*Primary Examiner*—Johnny D. Cherry
*Attorney, Agent, or Firm*—Ridout & Maybee

[57] ABSTRACT

The invention relates to an apparatus for rotating a suspended material handling unit comprising an elongated housing to suspend the upper end of the housing from a pivotable support, and a rotor member, having a material handling unit mounted thereto. A bearing is mounted externally of the housing between the ends of the housing so as to rotationally support the rotor member relative to the housing. A fluid operated rotary motor is mounted inside the housing and has a vertical drive shaft depending from the bottom of the housing. Drive members are operatively connected to the vertical drive shaft for rotating the rotor member and the material handling unit relative to the housing. A hydraulic swivel sleeve is mounted on the external surface of the housing unit below the bearing for rotation relative to the housing. A fluid operated motor for actuating the materials handling unit is provided as are fluid conducting members interconnecting this motor, the swivel sleeve and a source of operating fluid.

7 Claims, 4 Drawing Figures

ROTATIONAL GRAPPLE

This invention relates to a rotational material handling device or grapple of the mechanical jaw type and has as its object to improve on the construction and operating efficiency of such device.

The rotation feature of prior art rotational grapples is complicated by the presence of hydraulic feed lines which provide fluid to the cylinder which operates the grapple arms. In order to prevent the line from being damaged as a result of rotation, either the amount of rotation must be limited or a hydraulic swivel integrated into the design. A disadvantage of limited rotation is that the orientation of a grapple head to the load at pickup is critical to prevent forces from being generated at the rotational stop mechanism and causing failure. One of the disadvantages of hydraulic swivels is that they are typically integrated to the load-bearing shaft which in turn requires that structural displacements resulting from loading will effect the integrity of the seals.

An object of this invention is to provide a rotation bearing for a rotational grapple that is an integral part of an elongated tubular housing for supporting the grapple and a hydraulic swivel mounted in such a manner that it is not affected by loads being transmitted through the rotational bearing.

A further object of the invention is to provide a rotational grapple with a novel bearing which is interposed between the main stationary and rotational parts of the grapple head permitting the motor for rotating the grapple to be located internally of an elongated housing and permits the hydraulic swivel to be integrated into the structure in a manner such that the swivel is not affected by loads being transmitted through the rotational bearing.

These and other important features which will appear in the course of the following detailed description distinguish the invention structurally and operationally over the prior art U.S. Pat. Nos. 4,005,895, 4,005,894, 3,877,743 and 3,413,029.

In the drawings wherein like numerals refer to like parts:

Figure 1:
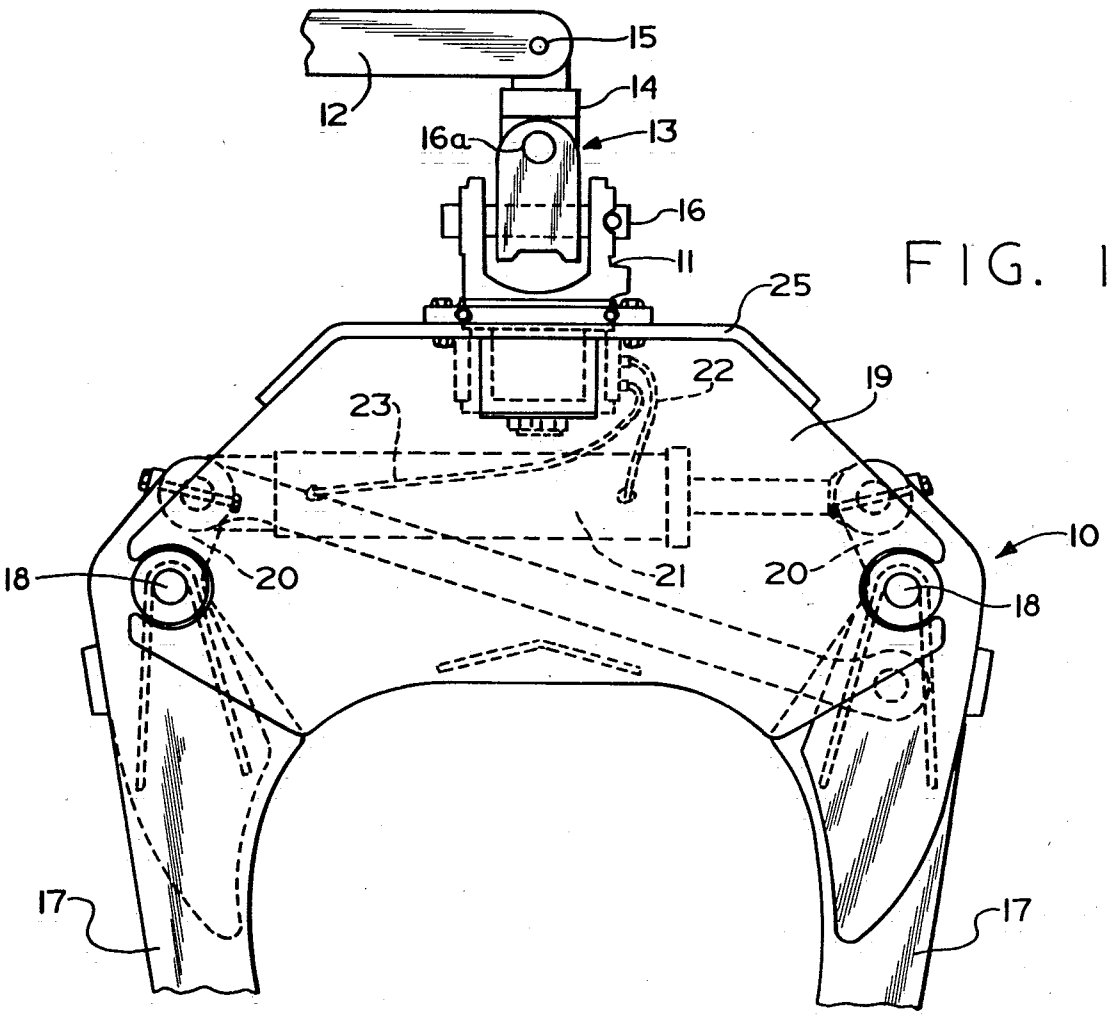
FIG. 1 is a front elevational view of the rotational grapple embodying the invention.
Figure 2:
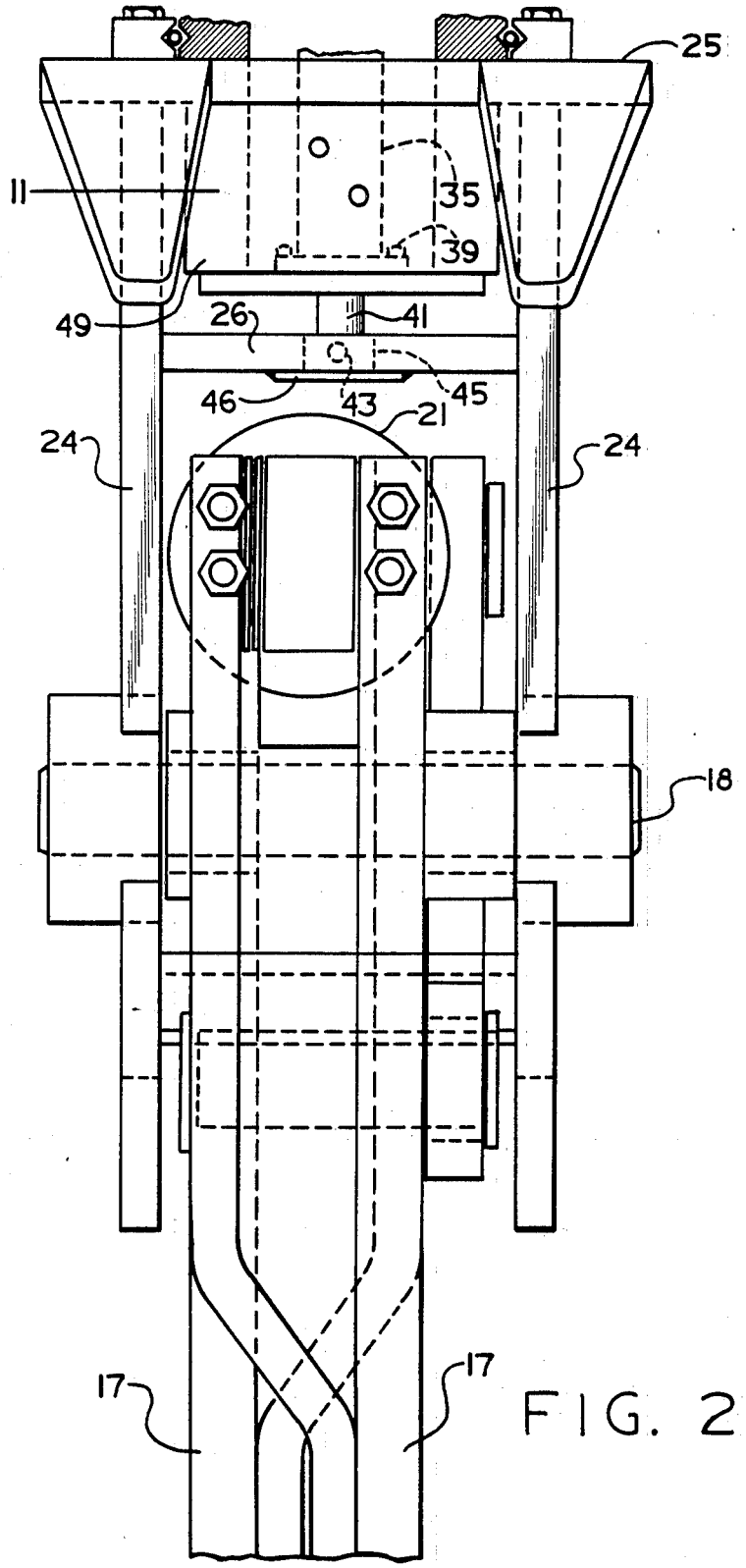
FIG. 2 is a fragmentary side elevational view with parts broken away of the rotational grapple embodying the invention.

Referring now to FIGS. 1 and 2 of the drawings, the grapple assembly or other material handling device, generally referred to by the numeral 10, is rotationally supported on a elongated tubular housing 11, which is supported from a boom 12 by means of a universal support 13 comprising a member 14 which is pivotably mounted to the boom 12 by means of a pivot pin 15. The universal support 13 has a pair of pivot pins 16 and a6*a* disposed perpendicular to each other. The pivot pin 16 supports the upper portion 11*a* of the housing 11 by passing through a pair of aligned holes in the upper portion 11*a*and prevented from moving axially by suitable fasteners at each end thereof.

The grapple assembly 10 comprises a pair of grapple arms or tines 17 pivotably mounted at one end by pins 18 to a grapple housing 19. Each of the tines 17 has a crank arm 20 welded to the upper end of the tine. An actuating cylinder 21 acting between the crank arms opens and closes the tines as pressurized hydraulic fluid is supplied to the cylinder by means of the hydraulic lines 22 and 23 connected to the central supply as will be more fully described hereinafter.

As shown in FIGS. 1 & 2, grapple housing 19 comprises a pair of spaced vertical plates 24 welded to a rotor plate 25 and a pair of cross plates 26 displaced vertically from the rotor plate 25 to provide a structurally rigid grapple housing 19.

The rotor plate 25 of the grapple housing 19 is provided with an annular outer bearing race 27 formed in a ring shaped member 28 suitably connected to the periphery of an annular hole in the rotor plate 25 as, for example, by means of a plurality of stud bolts 29. The outer surface of the median portion 11*b* of the housing 11 is provided with an annular inner bearing race 30, intermediate the upper and lower ends 11*a* and 11*c* of the housing. A plurality of ball bearings 33 bear against the outer and inner bearing races 27 and 30 to rotationally support the rotor plate and the grapple assembly 10 on the housing 11. A pair of annular lip seals 34 are provided adjacent the bearing races to seal the bearings 33 from dirt and to seal lubricant within the bearings and races.

Figure 4:
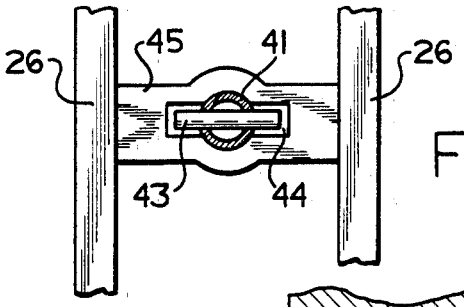
FIG. 4 is a fragmentary horizontal section taken substantially along line 4—4 of FIG. 3.
Figure 3:
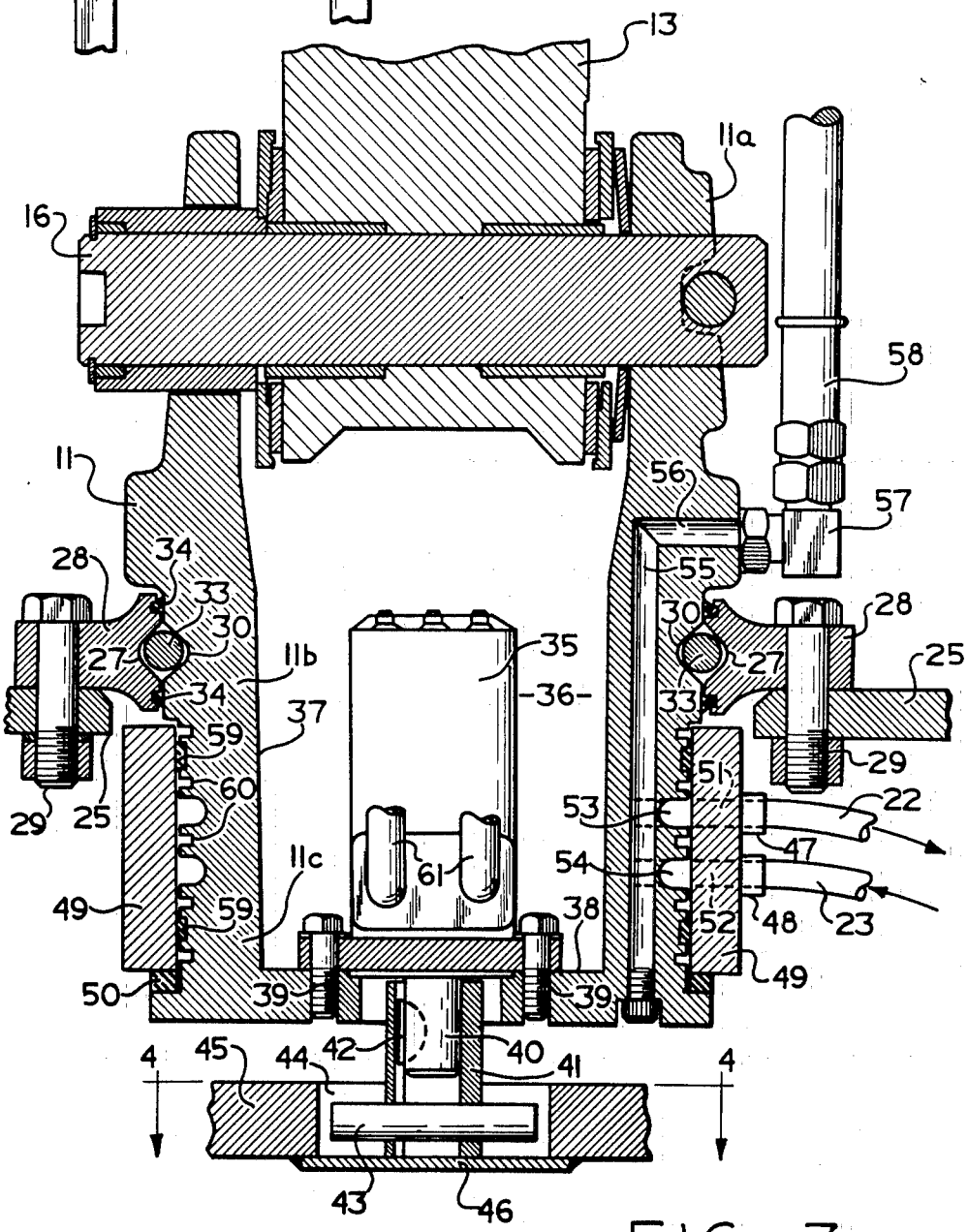
FIG. 3 is an enlarged fragmentary front elevational view with parts broken away and in cross-section of the rotational grapple embodying this invention.

The rotor plate 25 and grapple assembly 10 are rotated relative to a housing 11 by means of a rotary hydraulic motor 35 vertically mounted in the chamber 36 formed by the internal wall 37 of the housing 11. The motor 35 is fixed to a lower end wall 38 of the housing by a plurality of studs 39. Preferably, the axis of rotation of the drive shaft 40 of the motor 35 is coincident with the axis of rotation of the bearing races 27 and 30. Drive shaft 40 extends below the end plate 38 and is connected to a cylindrical coupling member 41 by a key 42. A keyhole shaped cross pin 43 is secured to the lower end of member 41. As shown in FIG. 4, the cross pin 43 fits into a keyhole shaped slot 44 formed in the drive plate 45 which is welded to the vertical plates 26 of the grapple housing. The slot 44 is covered by a cover plate 46 welded to the drive plate 45. Considerable clearance is provided between the edges of the cross pin 43 and the slot 44. A cover plate 46 encloses the slot 44 enabling the coupling member to move axially relative to shaft 40.

The hydraulic lines 22 and 23 which supply hydraulic fluid to the actuating cylinder 21 of the grapple assembly 10 are connected by suitable hose couplings 47 and 48 mounted on a swivel sleeve 49 which is mounted on the lower end 11*c* of the housing 11. The swivel sleeve 49 is supported on the housing 11 by an annular bearing 50 which permits the sleeve 49 to rotate with the grapple housing 19. Each of the hose couplings 47 and 48 are vertically aligned and communicate respectively with radially extending bores 51 and 52 through the sleeve 49 which communicates with annular grooves 53 and 54 formed in the outer surface of the lower end 11*c* of housing 11. The groove 53 is connected to a passage 55 extending vertically through the housing and communicates with a bore 56 into fluid communication with the hose coupling 57 connected by a hose 58 to the source of pressurized fluid. The groove 54 is likewise connected to a vertical passage in the housing to a hose coupling and hose connected to the fluid reservoir.

Suitable ring bearings 59 are provided between the swivel sleeve 49 and housing 11 on which the sleeve rotates relative to the housing. The annular grooves 53 and 54 are sealed by suitable seals 60 provided adjacent the grooves 53 and 54.

In operation, fluid is supplied to the hydraulic motor 35 through the hydraulic hoses 61 causing the drive shaft 40 to rotate in a clockwise or counter-clockwise direction and thus drives the grapple housing 19 in a clockwise or counter-clockwise direction. The combined load of the grapple assembly 10 and the load supported by the grapple is transmitted through the rotational bearing 33 to the housing 11. Such load does not effect the seals 60 of the hydraulic swivel sleeve 49 since the bearing 33 is located above the swivel sleeve and transmits forces directly to the housing 11 without effecting the seals of the swivel sleeve 49.

We claim:

1. An apparatus for rotating a suspended material handling unit comprising an elongated housing, means to suspend the upper end of said housing from a pivotable support, a rotor member having a material handling unit mounted thereto, a bearing means mounted externally of said housing and between the ends of said elongated housing for rotationally supporting said rotor member relative to said housing, a fluid operated rotary motor mounted internally of said housing and having a vertical drive shaft depending from the bottom of said housing, drive means operatively connected to said vertical drive shaft for rotating the rotor member and material handling unit relative to the housing, a hydraulic swivel sleeve mounted on the external surface of said housing below said bearing means, said sleeve mounted on said housing for rotation relative thereto, a fluid operated motor for actuating said material handling unit, and fluid conducting means interconnecting said fluid operated motor, said swivel sleeve and a source of operating fluid.

2. An apparatus as claimed in claim 1 in which said fluid conducting means includes passageways through said swivel sleeve communicating with passageways extending vertically through said housing to an outlet located vertically above the bearing means.

3. An apparatus as claimed in claim 1 in which said bearing means is located intermediately of the upper and lower portions of said housing.

4. An apparatus as claimed in claim 1 in which said bearing means includes an outer bearing race formed in the rotor member and an inner bearing race formed in the outer surface of said housing, forming the races for a plurality of ball bearings, said bearing means rotationally supporting said material handling unit.

5. An apparatus as claimed in claim 4 in which said rotary motor is mounted on a cross-plate at the lower end of said housing.

6. An apparatus as claimed in claim 4 in which the vertical axis of said vertical drive shaft is coincident with the vertical axis of said bearing means.

7. An apparatus as claimed in claim 1 in which the drive means includes means for permitting limited vertical movement between the vertical drive shaft and the rotor member.

* * * * *